US007706708B2

(12) United States Patent
Mori

(10) Patent No.: US 7,706,708 B2
(45) Date of Patent: Apr. 27, 2010

(54) IMAGE FORMING APPARATUS WHICH REDUCES THE WARM-UP TIME OF A FIXING DEVICE, AND CONTROL METHOD THEREOF

(75) Inventor: Shinya Mori, Numazu (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 594 days.

(21) Appl. No.: 11/668,575

(22) Filed: Jan. 30, 2007

(65) Prior Publication Data

US 2008/0181641 A1 Jul. 31, 2008

(51) Int. Cl.
*G03G 15/00* (2006.01)
*G03G 15/20* (2006.01)

(52) U.S. Cl. ..... 399/69; 399/88

(58) Field of Classification Search ..... 399/69, 399/88

See application file for complete search history.

(56) References Cited

U.S. PATENT DOCUMENTS 6,826,377 B2 * 11/2004 Kitozaki ..... 399/88
7,099,605 B2 * 8/2006 Namiki ..... 399/88
7,313,341 B2 * 12/2007 Matsusaka ..... 399/88
7,457,558 B2 * 11/2008 Yamamoto ..... 399/88
7,496,312 B2 * 2/2009 Sato et al. ..... 399/88

FOREIGN PATENT DOCUMENTS

JP 2004-200149 7/2004

* cited by examiner

*Primary Examiner*—William J Royer
(74) *Attorney, Agent, or Firm*—Turocy & Watson, LLP

(57) ABSTRACT

An image forming apparatus according to the invention includes an image forming apparatus main body and at least one option apparatus that is mounted on the main body when functions are extended. The main body includes a main power supply unit that converts a commercial power supply into a predetermined voltage, a first load that is driven by the main power supply unit, a first auxiliary power supply that is charged by the commercial power supply, and a fixing device including a main heater heated by the power of the commercial power supply and an auxiliary heater heated by the power of the first auxiliary power supply. The at least one option apparatus includes a second load driven by the power of the main power supply unit and a second auxiliary power supply that is charged by the commercial power supply when the at least one option apparatus is mounted, while heating the auxiliary heater in conjunction with the first auxiliary power supply.

12 Claims, 9 Drawing Sheets

IMAGE FORMING APPARATUS WHICH REDUCES THE WARM-UP TIME OF A FIXING DEVICE, AND CONTROL METHOD THEREOF

BACKGROUND OF THE INVENTION

1. Field of the Invention

The present invention relates to an image forming apparatus and a control method thereof, and, more particularly to an image forming apparatus employing an electrophotographic system and a control method thereof.

2. Description of the Related Art

In an image forming apparatus such as a copying machine employing an electrophotographic system, a process for developing an electrostatic latent image formed on a photoconductive drum using a toner or the like, transferring a toner image developed onto a recording sheet, and then heating and pressing the toner image with a fixing device to fix the toner image on the recording sheet is adopted.

As a structure of the fixing device, a form of using a heating roller having a heater built therein is often used. The toner image on the recording sheet is fixed by directly applying heat of the heating roller to the recording sheet or indirectly applying the heat to the recording sheet via a fixing belt or the like.

In order to secure satisfactory fixing performance, it is important to maintain the temperature of the heating roller within a predetermined range.

However, the temperature of the heating roller is low during starting of the image forming apparatus and immediately after the image forming apparatus is returned from a standby mode. Thus, in order to heat the heating roller using the heater to set the temperature of the heating roller within the predetermined temperature range, warm-up for a predetermined time is necessary. In order to reduce this warm-up time, there is a form of using an auxiliary heater in addition to a normal heater (hereinafter referred to as main heater).

In an image forming apparatus of this form, usually, a commercial power supply is used as a power supply for the main heater and a chargeable auxiliary power supply is mainly used as a power supply for the auxiliary heater. As the auxiliary power supply, for example, a structure that uses an electric double layer capacitor is often adopted.

When a voltage of the auxiliary power supply falls, it is necessary to charge the auxiliary power supply with the commercial power supply. However, if the driving of the main heater and the charging of the auxiliary power supply are simultaneously performed, it is likely that power consumption of the commercial power supply increases and exceeds a standard value of maximum power that can be supplied from one wall outlet (e.g., in the case of a general wall outlet in Japan, 1500 W (100 V, 15 A)).

Thus, for example, in JP-A 2004-200149, there is disclosed a technique concerning an inter-apparatus power cooperative system in which plural apparatuses (image forming apparatuses) having auxiliary power supplies are capable of exchanging electric power of the auxiliary power supplies with one another.

With this disclosed technique, even when an auxiliary power supply voltage of one apparatus (an apparatus A) falls and an auxiliary heater of the apparatus A cannot be used, since electric power of an auxiliary power supply of another apparatus (an apparatus B) is supplied to the auxiliary heater of the apparatus A, it is possible to simultaneously use a main heater and the auxiliary heater in the apparatus A. Consequently, it is possible to reduce a warm-up time.

However, in the inter-machine power cooperative system disclosed by JP-A 2004-200149, it is necessary to provide main power supplies and auxiliary power supplies with a charging function in the respective apparatuses. Thus, cost of the respective apparatuses increases.

Although a warm-up time is reduced for an apparatus that receives supply of electric power of an auxiliary power supply from another apparatus, for an apparatus that supplies the electric power of the auxiliary power supply, a warm-up time increases to the contrary compared with that in the case in which the electric power of the auxiliary power supply is not supplied to the power receiving apparatus.

In JP-A 2004-200149, there is also disclosed a form in which apparatuses exchange commercial power supplies via a dedicated power cable. In this form, as in the technique described above, for an apparatus that supplies electric power of a commercial power supply, since electric power that can be supplied to a heater of the apparatus itself falls compared with the case in which the electric power of the commercial power supply is not supplied to a power receiving apparatus, a warm-up time increases. In order to prevent such a situation, an auxiliary power supply for supplementing electric power of the commercial power supply supplied to the power receiving apparatus needs to be built in the apparatus that supplies the electric power. Then, cost increases because of cost of the auxiliary power supply.

SUMMARY OF THE INVENTION

The invention has been devised in view of the above-mentioned circumstances and it is an object of the invention to provide an image forming apparatus that can reduce a warm-up time of a fixing device at low cost and a control method thereof.

In order to attain the object, an image forming apparatus according to an aspect of the invention is an image forming apparatus including an image forming apparatus main body and at least one option apparatus that is mounted on the image forming apparatus main body when functions are extended. The image forming apparatus main body includes a main power supply unit that converts a commercial power supply into a predetermined voltage, a first load that is driven on the basis of electric power supplied from the main power supply unit, a first auxiliary power supply that is charged by the commercial power supply, and a fixing device including a main heater that is heated on the basis of the electric power supplied from the commercial power supply and an auxiliary heater that is heated on the basis of the electric power supplied from the first auxiliary power supply. The option apparatus includes a second load that is driven on the basis of electric power supplied from the main power supply unit when the option apparatus is mounted on the image forming apparatus main body and a second auxiliary power supply that is charged by the commercial power supply when the option apparatus is mounted on the image forming apparatus main body and, on the other hand, heats the auxiliary heater in conjunction with the first auxiliary power supply.

In order to attain the above-mentioned object, a control method of an image forming apparatus according to another aspect of the invention is a control method of an image forming apparatus including an image forming apparatus main body and at least one option apparatus that is mounted on the image forming apparatus main body when functions are extended. The control method of an image forming apparatus includes, in the image forming apparatus main body, converting a commercial power supply into a predetermined voltage with a main power supply unit, driving a first load on the basis of electric power supplied from the main power supply unit, charging a first auxiliary power supply with the commercial power supply, heating a main heater included in a fixing device on the basis of the electric power supplied from the commercial power supply, heating an auxiliary heater further included in the fixing device on the basis of the electric power supplied from the first auxiliary power supply and, when the option apparatus is mounted on the image forming apparatus main body, driving a second load included in the option apparatus on the basis of the electric power supplied from the main power supply unit, charging a second auxiliary power supply included in the option apparatus with the commercial power supply, and, on the other hand, heating the auxiliary heater with both the second auxiliary power supply and the first auxiliary power supply.

DETAILED DESCRIPTION OF THE INVENTION

Embodiments of an image forming apparatus and a control method thereof according to the invention will be explained with reference to the accompanying drawings.

(1) Structure of an Image Forming Apparatus

An image forming apparatus 1 according to an embodiment of the invention is, for example, a digital copying machine employing an electrophotographic system. The image forming apparatus 1 includes an image forming apparatus main body 100 and plural extended option apparatuses (option apparatuses).

The image forming apparatus main body 100 is an apparatus that has all basic functions of the digital copying machine ranging from scanning of an original to printing of an image on a sheet. On the other hand, the extended option apparatuses are apparatuses that are configured to be detachably mountable on the image forming apparatus main body 100 and are apparatuses that extend or improve functions of the copying machine by being mounted on the image forming apparatus main body 100.

The extended option apparatuses are, for example, an auto document feeder (an option apparatus (a)) 200*a*, an extended sheet feeding tray apparatus (an option apparatus (b)) 200*b*, and a finisher apparatus (an option apparatus (c)) 200*c*.

The auto document feeder 200*a* is an apparatus that is usually mounted on the image forming apparatus main body 100, automatically feeds plural originals to a scanner unit 2 (see FIG. 1) of the image forming apparatus main body 100, and realizes a high-speed automatic scanning function.

The extended sheet feeding tray apparatus 200*b* is an apparatus that is usually mounted below the image forming apparatus main body 100 and stores and feeds, for example, a large quantity of A4 sheets and plural sheets of different sizes (e.g., sheets of an A3 size, a B5 size, and a B4 size).

The finisher apparatus 200*c* is an apparatus that is usually mounted on a side of the image forming apparatus main body 100 and has a function of performing, when plural copies are printed, stapling and the like of each of the copies other than sorting the copies one by one.

Among the components of the image forming apparatus 1 according to this embodiment, first, the image forming apparatus main body 100 will be schematically explained.

Figure 1:
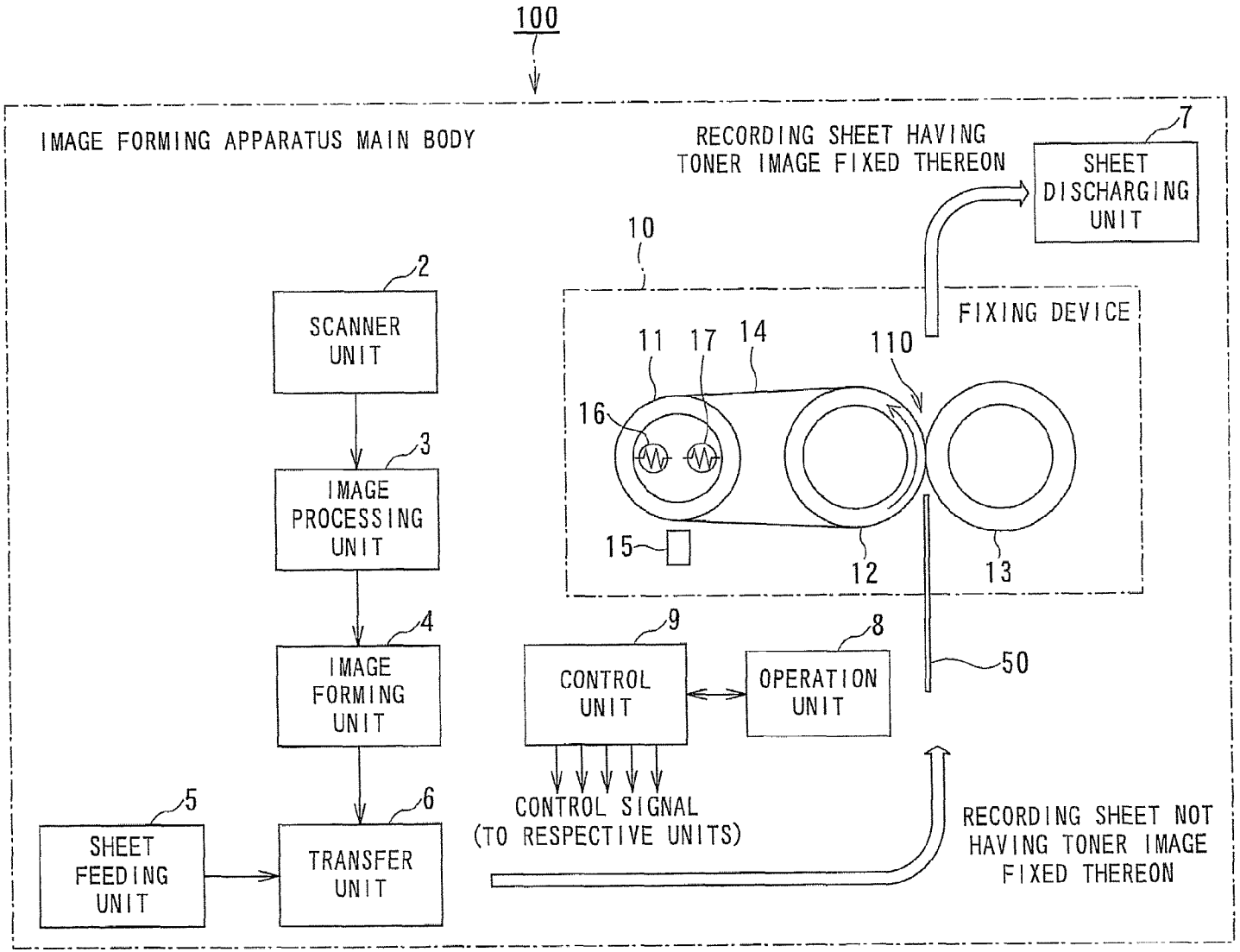
FIG. 1 is a diagram showing an example of a structure of an image forming apparatus main body according to a first embodiment of the invention.

FIG. 1 is a diagram showing an example of a structure of the image forming apparatus main body 100 according to a first embodiment of the invention.

The image forming apparatus main body 100 includes, for example, a scanner unit 2, an image processing unit 3, an image forming unit 4, a sheet feeding unit 5, a transfer unit 6, a sheet discharging unit 7, an operation unit 8, a control unit 9, and a fixing device 10.

The scanner unit 2 scans reflected light from an original with, for example, a CCD sensor and converts the reflected light into image data.

The image processing unit 3 applies various kinds of image processing such as color conversion processing, filtering processing, and gradation processing to the image data scanned.

The image forming unit 4 performs, for example, pulse width modulation according to intensity of the image data subjected to the image processing and forms an electrostatic latent image on a photoconductive drum using a laser beam or the like. Moreover, the image forming unit 4 develops the electrostatic latent image with a toner and forms a toner image on the photoconductive drum.

The transfer unit 6 transfers the toner image on the photoconductive drum onto a sheet conveyed from the sheet feeding unit 5. The transfer from the photoconductive drum onto the sheet may be directly performed or the toner image on the photoconductive drum may be intermediately transferred onto an intermediate transfer member once and transferred onto the sheet from the intermediate transfer member again.

A sheet (a sheet not having the toner image fixed thereon) 50 having the toner image transferred thereon is outputted from the transfer unit 6 to the fixing device 10. The sheet having the toner image fixed thereon by the fixing device 10 is outputted to the outside from the sheet discharging unit 7.

The operation unit 8 includes, for example, an operation panel including a liquid crystal display and a touch panel and appropriate keys.

The control unit 9 includes a processor and the like and performs control of the entire image forming apparatus 1. As described later, ON and OFF control of a main heater 16 of the fixing device 10 and ON and OFF control of charging of a first auxiliary power supply 60 and the like are also performed by this control unit 9.

FIG. 1 is a diagram showing an example of a structure of the image forming apparatus main body 100 serving as a copying machine. However, it is also possible to cause the image forming apparatus main body 100 to function as a printer. In this case, image data created in an external apparatus such as a personal computer is inputted to the image processing unit 3 via an external interface (not shown).

A detail structure of the fixing device 10 will be explained.

The fixing device 10 includes a heating roller 11, a fixing roller 12, a pressure roller 13, and a fixing belt 14. A temperature sensor 15 is disposed near the heating roller 11.

The fixing belt 14 is an endless belt wound around the heating roller 11 and the fixing roller 12 and turns between the heating roller 11 and the fixing roller 12.

The pressure roller 13 is set in press contact with the fixing roller 12 via the fixing belt 14. The sheet 50 not having a toner image fixed thereon conveyed from the transfer unit 6 is applied with heat and pressure while the sheet 50 passes through a contact portion (a nip portion 110) between the pressure roller 13 and the fixing belt 14 and the unfixed toner image is fixed on the sheet 50.

The fixing belt 14 is formed by using a thin seamless belt molded from metal such as nickel or heat resistant resin such as polyimide as a substrate and coating heat resistant rubber such as silicone rubber or fluororubber and fluorine resin impregnated with oil over the surface of the substrate or formed by coating heat resistant highly releasable resin such as PFA (PerFluoro alkoxyl Alkane) tube over silicone rubber.

In this embodiment, a heat resistant elastic layer of silicone rubber is provided on an outer peripheral surface of a thin seamless belt formed by nickel electrocasting and a tube is coated over the outer peripheral surface. On the inner side of this fixing belt 14, there are arranged the heating roller 11 that heats the fixing belt 14 and applies tension to this fixing belt 14 and the fixing roller 12 that drives the fixing belt 14 and forms a fixing area between the fixing roller 12 and the pressure roller 13.

The heating roller 11 according to this embodiment is formed by coating a coating layer of PTFE (Poly TetraFluoro Ethylene) over a core bar of an aluminum pipe.

A main heater 16 and an auxiliary heater 17 are provided in the inside of the heating roller 11 as heat generating sources. The main heater 16 is a shaft-like heater lamp that uses a commercial power supply as a power source. The auxiliary heater 17 is a shaft-like heater lamp that uses a chargeable auxiliary power supply, for example, an electric double layer capacitor as a power source.

In the form shown in FIG. 1, both the main heater 16 and the auxiliary heater 17 are built in the heating roller 11. However, the main heater 16 and the auxiliary heater 17 are not limited to this form.

Figure 2:
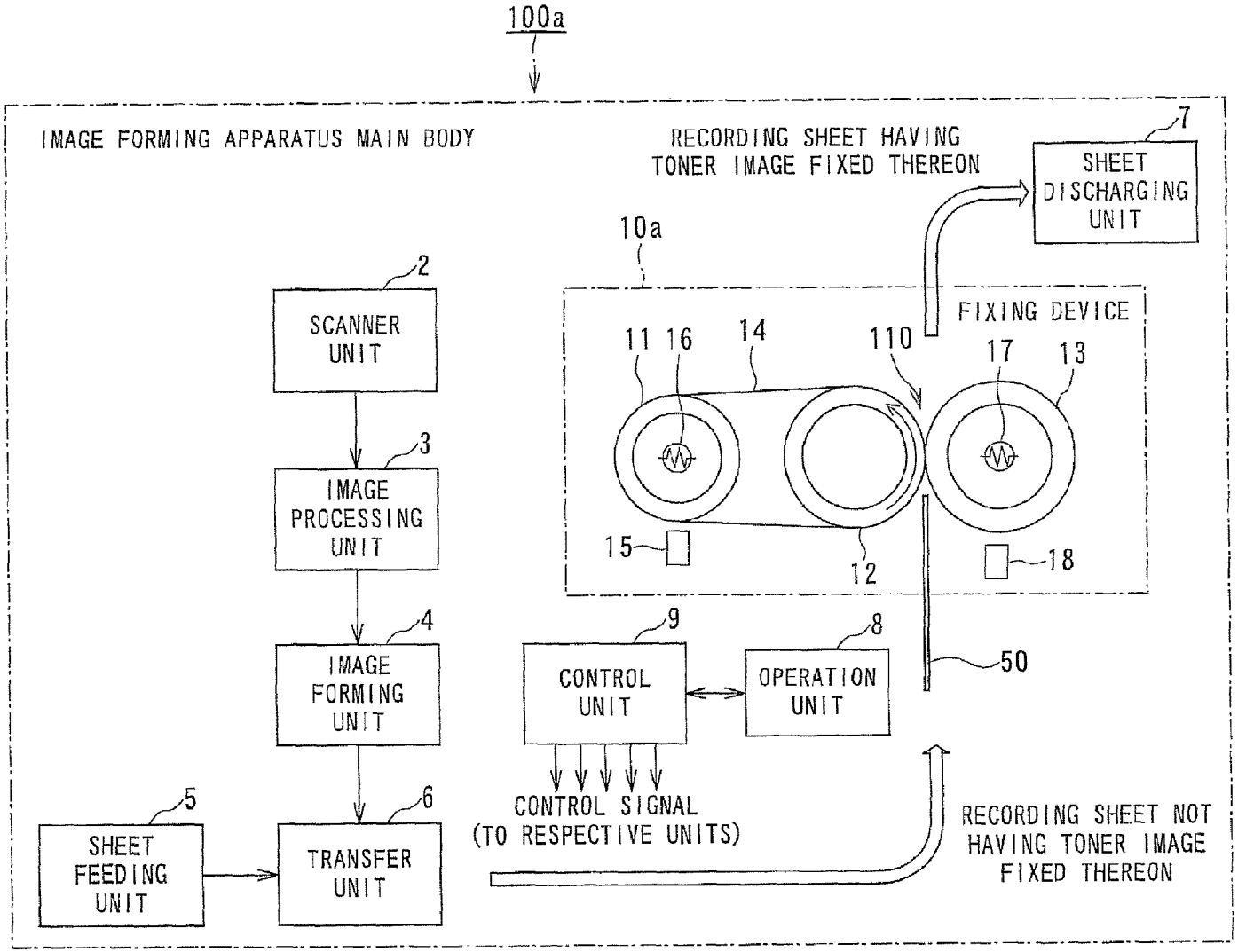
FIG. 2 is a diagram showing an example of a structure of an image forming apparatus main body according to a second embodiment of the invention.

For example, FIG. 2 is a diagram showing an example of a structure of an image forming apparatus main body 100*a* according to a second embodiment. In a fixing device 10*a* of the second embodiment, the main heater 16 is built in the heating roller 11 and, on the other hand, the auxiliary heater 17 is built in the pressure roller (in this case, performing both pressing and heating) 13. In the second embodiment, in order to detect the temperature of the pressure roller 13, a temperature sensor 18 is provided near the pressure roller 13.

Figure 3:
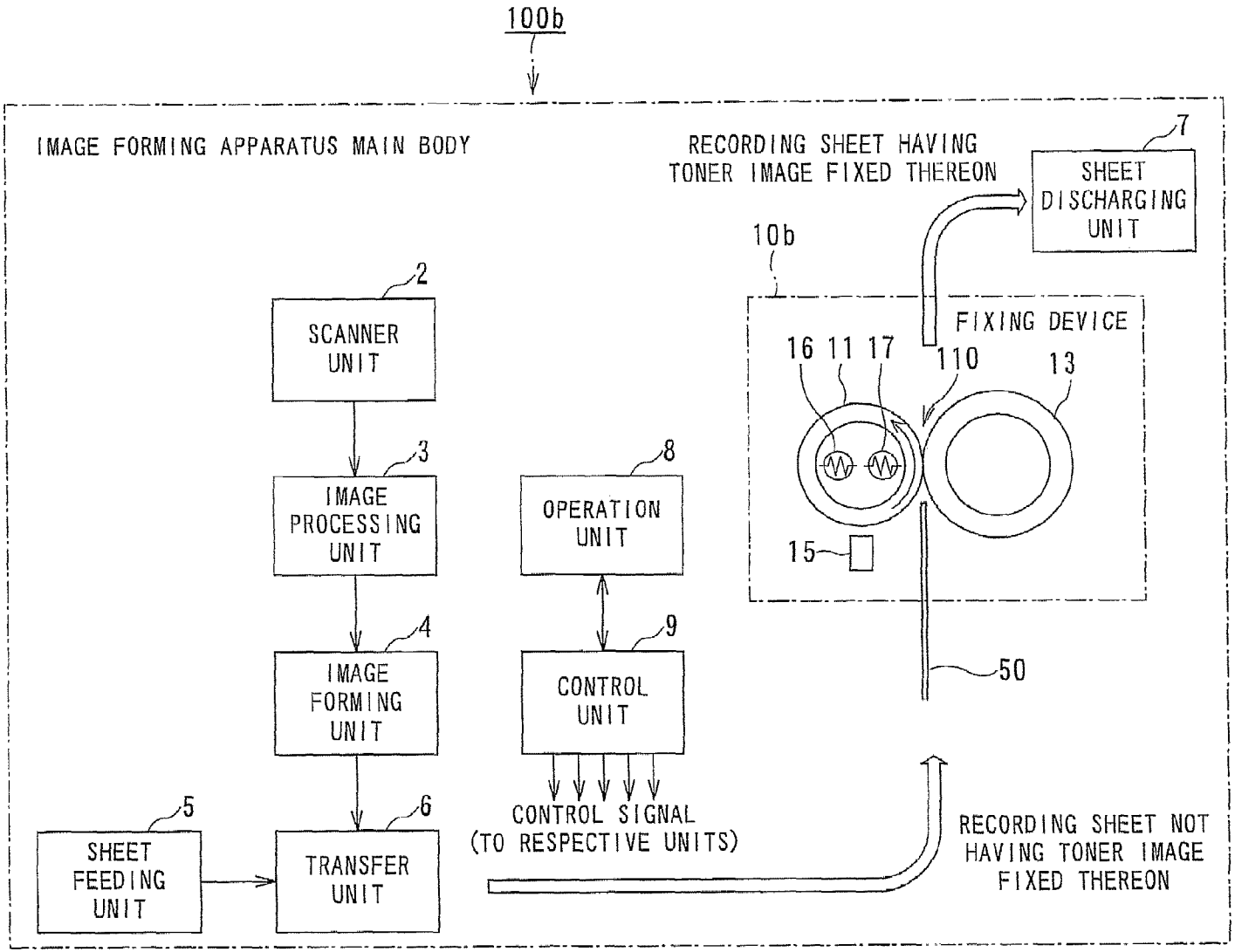
FIG. 3 is a diagram showing an example of a structure of an image forming apparatus main body according to a third embodiment of the invention.

Besides, as in an image forming apparatus main body 100*b* according to a third embodiment shown in FIG. 3, the heating roller 11 and the pressure roller 13 are directly in contact with each other without the intervention of the fixing belt 14 to form the nip portion 110. In a fixing device 10*a* of the second embodiment, as in the above case, both the main heater 16 and the auxiliary heater 17 may be built in the heating roller 11 as shown in FIG. 3. Alternatively, although not shown in the figure, it is also possible that the main heater 16 is built in the heating roller 11 and the auxiliary heater 17 is built in the pressure roller 13.

The point of this embodiment resides in structures of a power supply (the commercial power supply) that supplies electric power to the main heater 16 and a power supply (an auxiliary power supply) that supplies electric power to the auxiliary heater 17 and a method of controlling the supply of electric power of the power supplies. The power supply structures and the control method thereof will be hereinafter explained.

Figure 4:
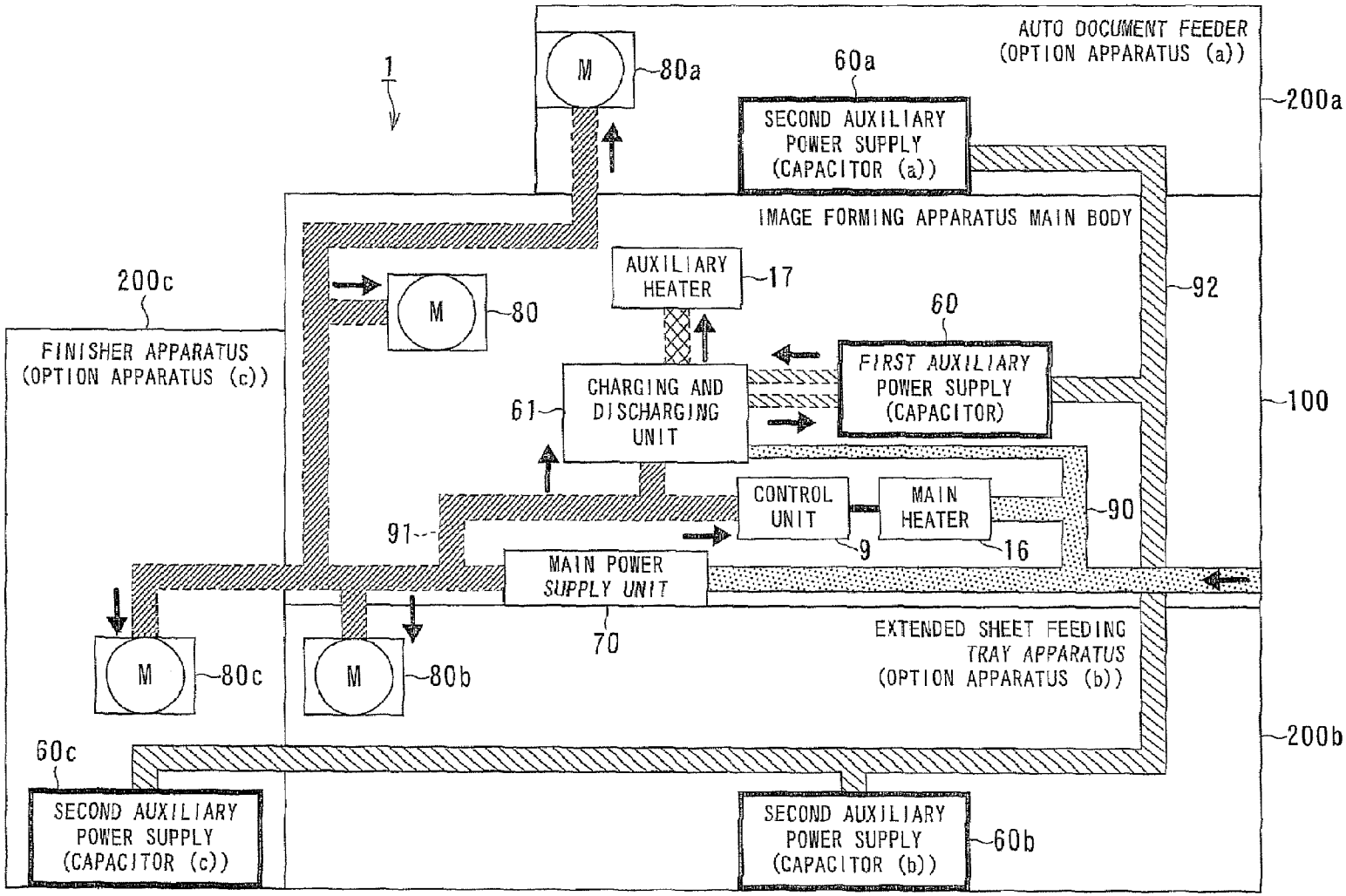
FIG. 4 is a diagram showing an example of an overall structure of an image forming apparatus according to an embodiment of the invention and, in particular, chiefly showing an example of structures of a power supply system and a load thereof.

(2) Power Supply Structures of an Image Forming Apparatus and a Control Method Thereof FIG. 4 is a diagram showing an example of a structure of the image forming apparatus 1 according to this embodiment and, in particular, chiefly showing an example of structures of a power supply system and a load thereof.

As described above, the image forming apparatus 1 includes the image forming apparatus main body 100 and includes, as the extended option apparatuses mounted on the image forming apparatus main body 100, the auto document feeder 200*a*, the extended sheet feeding tray apparatus 200*b*, and the finisher apparatus 200*c*.

The image forming apparatus main body 100 includes a main power supply unit 70, the control unit 9, a charging and discharging unit 61, the first auxiliary power supply (the capacitor) 60, the main heater 16, the auxiliary heater 17, and a first load 80.

A commercial power supply 90 supplied from a wall outlet or the like is converted by the main power supply unit 70 into a power supply suitable for the components in the image forming apparatus main body 100 and the extended option apparatus, for example, a DC power supply having a predetermined voltage (a power supply outputted from a secondary side of the main power supply unit 70 will be hereinafter collectively referred to as converted power supply 91). The converted power supply 91 is supplied to the components in the image forming apparatus main body 100 with the components as loads. For example, the converted power supply 91 is supplied to the control unit 9, circuits in the charging and discharging unit 61, and the first load 80.

The first load 80 collectively represents the components in the image forming apparatus main body 100 as a load for the converted power supply 91 (excluding the control unit 9 and the charging and discharging unit 61). All of various motors used for sheet conveyance and driving of various rollers and loads such as various circuits and the like of the image processing unit 3 and the like are included in the first load 80.

The converted power supply 91 is not only supplied to the loads in the image forming apparatus main body 100 but also supplied to, when each of the extended option apparatuses is mounted, loads (second loads) in the extended option apparatuses.

For example, when the auto document feeder 200*a* is mounted, the converted power supply 91 is supplied from the main power supply unit 70 with an original feeding motor and the like, which are held by the auto document feeder 200*a*, as a second load 80*a*.

When the extended sheet feeding tray apparatus 200*b* is mounted, the converted power supply 91 is supplied from the main power supply unit 70 with, for example, a sheet conveying motor and the like, which are built in the extended sheet feeding tray apparatus 200*b*, as a second load 80*b*.

Moreover, when the finisher apparatus 200*c* is mounted, the converted power supply 91 is supplied from the main power supply unit 70 with, for example, a motor for driving a sorting mechanism and a stapling mechanism in the finisher apparatus 200*c* and the like as a second load 80*c*.

On the other hand, the commercial power supply 90 is not only used as a primary power supply for the main power supply unit 70 but also used as a power supply for the main heater 16 for heating the fixing device 10 and as a charging power supply for charging the first auxiliary power supply 60 and the second auxiliary power supplies 60*a*, 60*b*, and 60*c*.

The charging and discharging unit 61 applies, under the control by the control unit 9, charging and discharging control to the first auxiliary power supply 60 when the extended option apparatuses are not mounted and applies charging and discharging control to both the first auxiliary power supply 60 and the second auxiliary power supplies 60*a*, 60*b*, and 60*c* when the extended option apparatuses are mounted.

The first auxiliary power supply 60 and the second auxiliary power supplies 60*a*, 60*b*, and 60*c* may be constituted by a chargeable large-capacity battery. However, from the viewpoint of a charging time and the like, an electric double layer capacitor is preferable.

When the extended option apparatuses are mounted, capacities of the first auxiliary power supply 60 and the second auxiliary power supplies 60*a*, 60*b*, and 60*c* are added up and increased by simply connecting, with a connecting line 92, respective electric double layer capacitors constituting the auxiliary power supplies 60, 60*a*, 60*b*, and 60*c*. Concerning the charging and discharging control, the same control only has to be applied to the charging and discharging unit 61 regardless of whether the extended option apparatuses are mounted or not mounted. This is convenient from the viewpoint of control.

Usually, a heating period for the main heater 16 and a charging period for the auxiliary power supplies 60, 60*a*, 60*b*, and 60*c* are controlled not to overlap each other. However, since the main heater 16 and the loads (the first load 80 and the second loads 80*a*, 80*b*, and 80*c*) operate simultaneously, it is important to prevent power consumption of the commercial power supply 90 from exceeding specified electric power. This point will be described in detail later because this point forms the point of this embodiment.

The auxiliary heater 17 is a heater that heats the fixing device 10 in conjunction with the main heater 16. When the extended option apparatuses are not mounted, the first auxiliary power supply 60 is used as a power supply. When the extended option apparatuses are mounted, both the auxiliary power supply 60 and the second auxiliary power supplies 60*a*, 60*b*, and 60*c* are used as power supplies.

A period in which both the auxiliary heater 17 and the main heater 16 are used is mainly a warm-up period. Immediately after starting energization, since the fixing device 10 is cooled, satisfactory fixing performance cannot be secured. The warm-up period is provided to heat the fixing device 10 and set the temperature of the fixing device 10 in a predetermined temperature range. In order to reduce this warm-up period as much as possible and bring the fixing device 10 into a preparation completed state (a ready state) within a predetermined specified time, both the main heater 16 and the auxiliary heater 17 are used.

A control method of the image forming apparatus 1 constituted as described above will be explained using FIGS. 5A and 5B and FIGS. 6A and 6B.

Figure 5A:
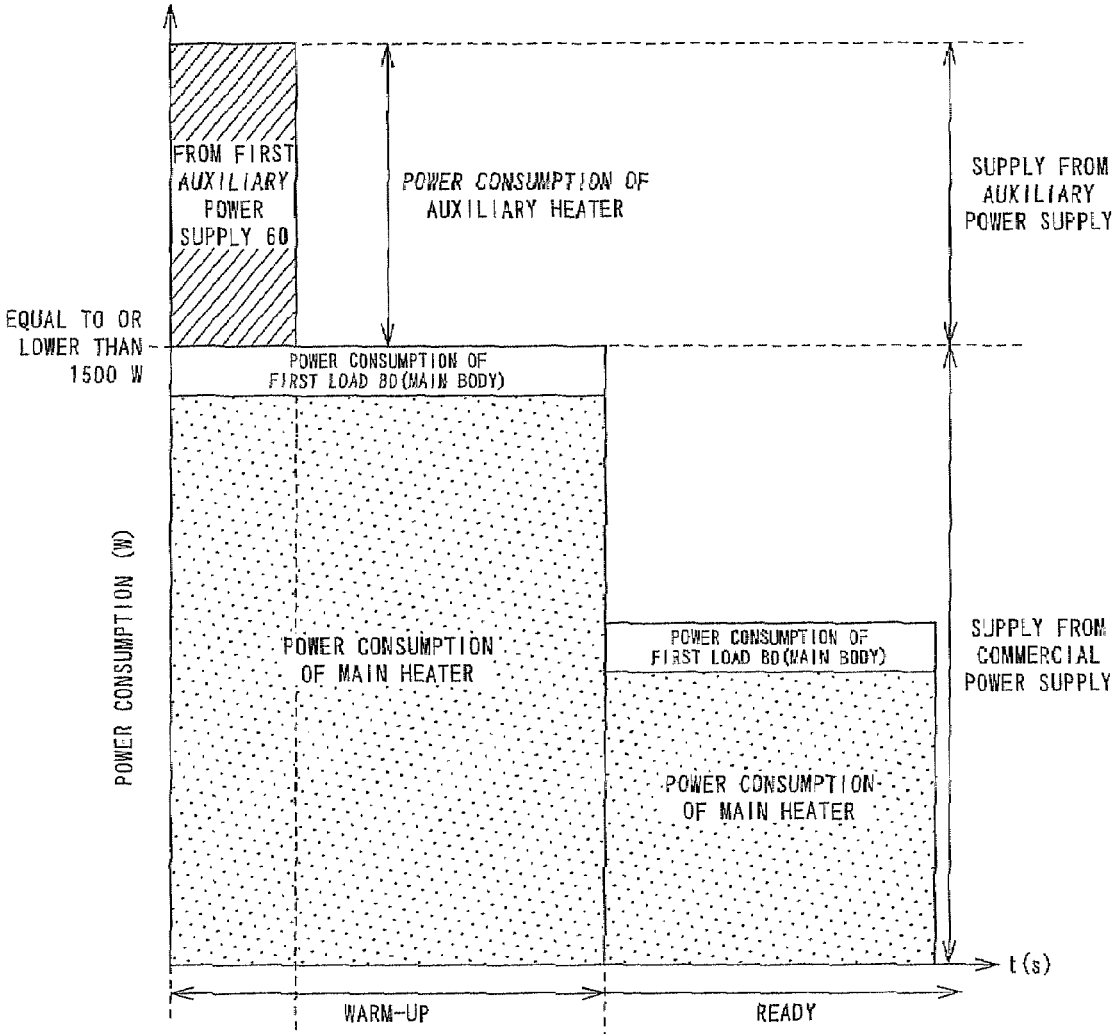
FIG. 5A is a diagram showing, together with elapse of time, the distribution of power consumption at the time when an extended option apparatus is not mounted in the image forming apparatus according to the embodiment of the invention.

FIG. 5A is a diagram showing, together with elapse of an energization time, a consumption state of the commercial power supply 90 and the auxiliary power supply (in this case, the first auxiliary power supply 60 included in the image forming apparatus main body 100) at the time when the extended option apparatuses are not mounted.

Figure 5B:
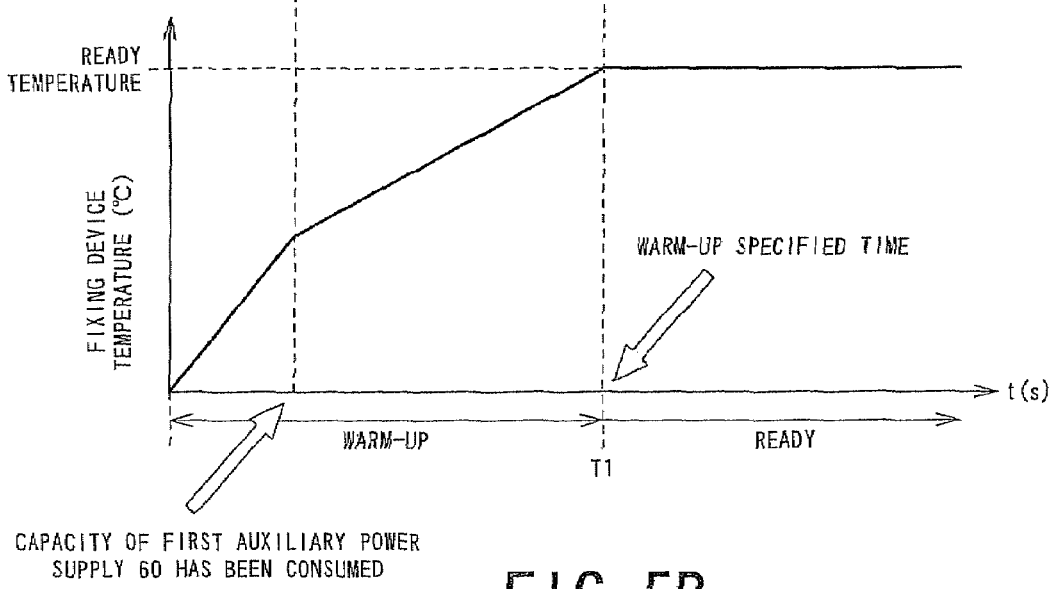
FIG. 5B is a diagram showing a change in a fixing temperature at that time together with elapse of time in the image forming apparatus according to the embodiment of the invention.

FIG. 5B is a diagram showing, together with elapse of an energization time, a temperature change of the fixing device 10 at the time when the extended option apparatuses are not mounted. It is assumed that the first auxiliary power supply 60 is sufficiently charged during starting of energization.

As shown in FIG. 5A, electric power of the commercial power supply 90 is consumed by the main heater 16, which heats the fixing device 10, and the loads (the first load 80) of the image forming apparatus main body 100.

In this case, power consumption of the main heater 16 and power consumption of the loads are set to prevent total power consumption of the commercial power supply 90 from exceeding specified electric power. This specified electric power for the commercial power supply 90 is maximum rated electric power that can be extracted from one wall outlet using one power supply cable, for example, 1500 W (in the case of Japan, 100 V, 15 A).

When the power consumption of the commercial power supply 90 exceeds this specified electric power, for example, it is necessary to connect two power supply cables to two wall outlets. This is inconvenient in terms of handling. There is also a method of using a higher voltage, for example, a voltage of 200 V as a voltage of a commercial power supply and supplying large electric power with one power supply cable. However, since wiring work may be required additionally, this method is also inconvenient.

Therefore, in this embodiment, electric power that can be extracted from a normal wall outlet with one power supply cable is set as specified electric power (e.g., 1500 W). Power consumption of the commercial power supply 90 consumed by the image forming apparatus 1 is distributed to be within this specified electric power.

On the other hand, during starting of energization of the image forming apparatus 1, warm-up is performed to raise the temperature of the fixing device 10 to a predetermined ready temperature. It is necessary to finish this warm-up within a specified time T1.

Therefore, as shown in FIG. 5A, during the warm-up, the fixing device 10 is heated using the auxiliary heater 17 in addition to the main heater 16.

Since the first auxiliary power supply 60 is used as a power supply for the auxiliary heater 17, the commercial power supply 90 is not consumed. Power consumption of the commercial power supply 90 does not exceed the specified electric power, for example, 1500 W.

However, since a capacity of the first auxiliary power supply 60 has an upper limit, the power supply capacity is fully consumed if discharge is continued for a fixed time.

Therefore, although a rising gradient of a fixing temperature is large in the beginning of the warm-up period because it is possible to heat the fixing device 10 with both the auxiliary heater 17 and the main heater 16, the rising gradient of the fixing temperature is dulled after the capacity of the first auxiliary power supply 60 is fully consumed because the fixing device 10 is heated only by the main heater 16.

Naturally, since a discharge time is increased by increasing the capacity of the first auxiliary power supply 60 and a period with a large temperature rise gradient also is extended, it is possible to reduce the warm-up time.

However, in this case, the first auxiliary power supply 60 built in the image forming apparatus main body 100 is increased in size and is increased in cost.

Thus, in this embodiment, a warm-up time that a user considers allowable is set as a specified time thereof and the first auxiliary power supply 60 is reduced in size and cost as long as warm-up of the fixing device 10 is finished within the warm-up time set. In this way, the image forming apparatus 1 excellent in a balance of cost and performance is realized.

After the fixing device 10 reaches the ready temperature, the temperature of the fixing device 10 only has to be maintained in the predetermined temperature range. Then the auxiliary heater 17 is unnecessary (therefore, supply of electric power from the first auxiliary power supply 60 is also unnecessary). It is possible to heat the fixing device 10 with only the main heater 16, and a small heating amount is sufficient as a heating amount of the main heater 16 compared with that during the warm-up period.

The operations described above are operations performed when the extended option apparatuses are not mounted. Operations performed when the extended option apparatuses are mounted will be explained.

Figure 6A:
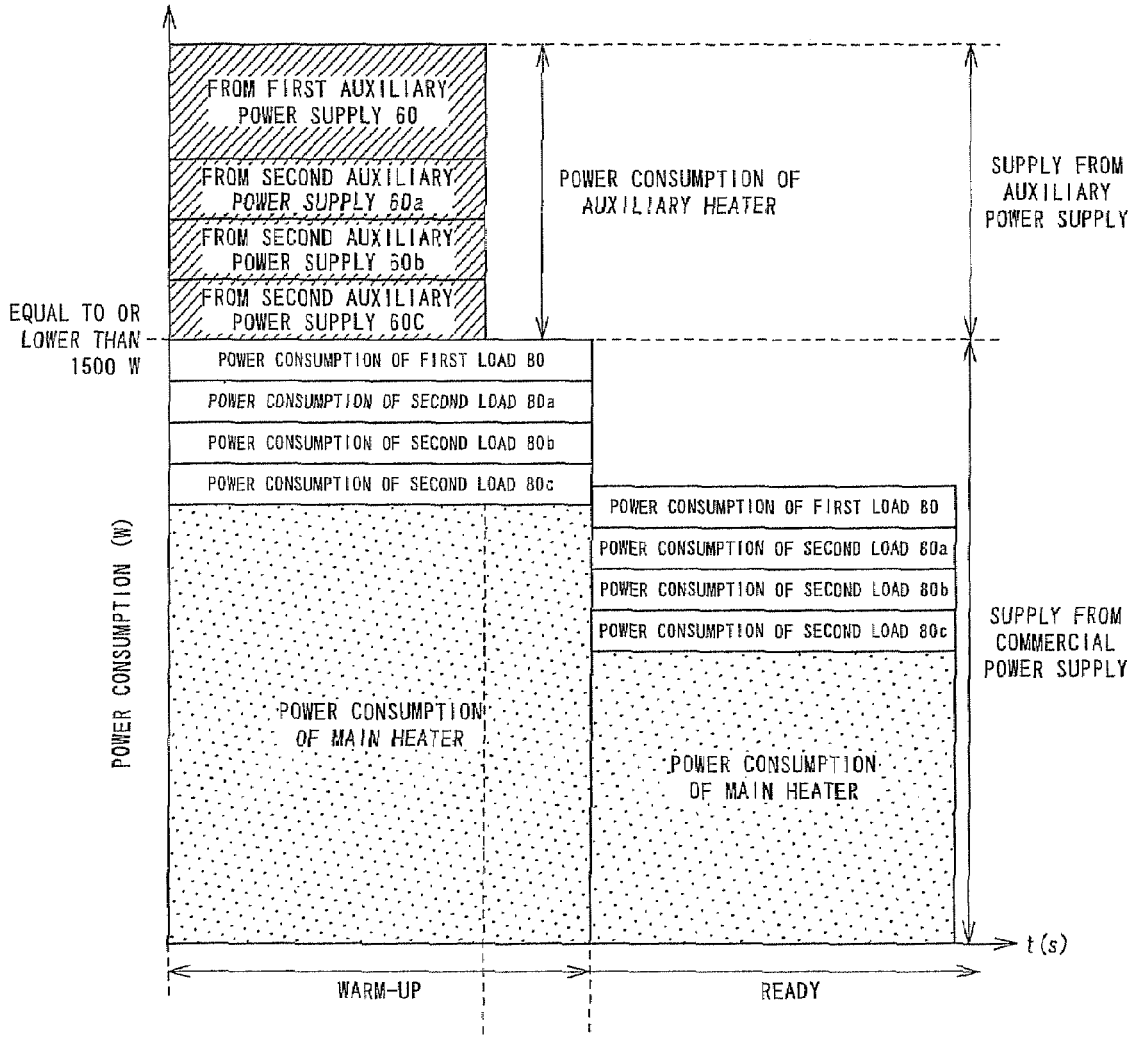
FIG. 6A is a diagram showing, together with elapse of time, the distribution of power consumption at the time when the extended option apparatus is mounted in the image forming apparatus according to the embodiment of the invention.

FIG. 6A is a diagram showing, together with elapse of an energization time, a consumption state of the commercial power supply 90 and the auxiliary power supplies (in this case, the first auxiliary power supply 60 included in the image forming apparatus main body 100 and the second auxiliary power supplies 60*a*, 60*b*, and 60*c* included in the respective extended option apparatuses 200*a*, 200*b*, and 200*c*) at the time when the extended option apparatuses are mounted.

Figure 6B:
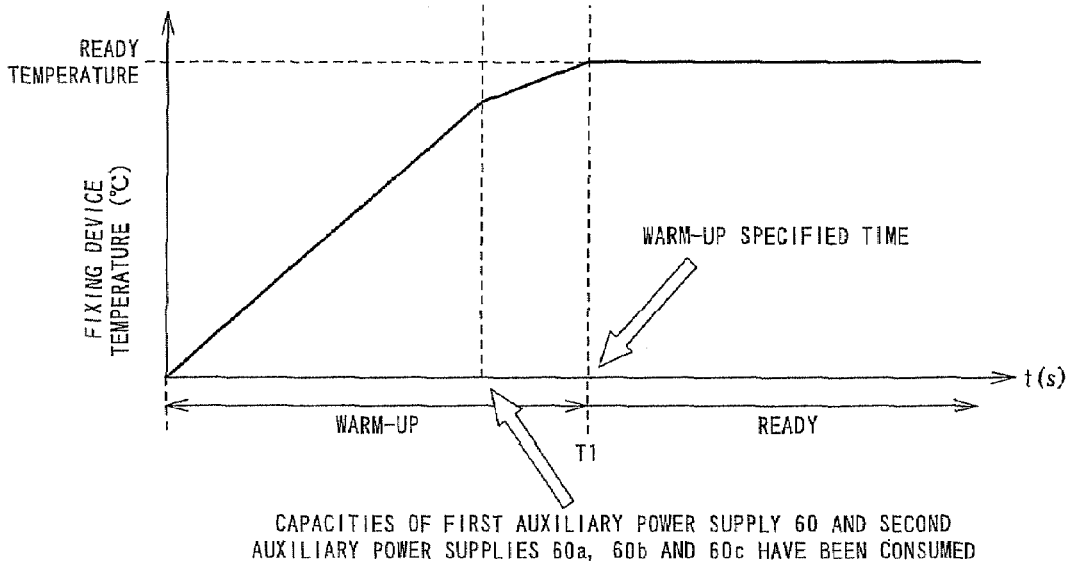
FIG. 6B is a diagram showing a change in a fixing temperature at that time together with elapse of time in the image forming apparatus according to the embodiment of the invention.

FIG. 6B is a diagram showing, together with elapse of an energization time, a temperature change of the fixing device 10 at the time when the extended option apparatuses are mounted.

As shown in FIG. 6A, electric power of the commercial power supply 90 at the time when the extended option apparatuses are mounted is consumed by the main heater 16, which heats the fixing device 10, and the loads (the first load 80) of the image forming apparatus main body 100. In addition, the electric power of the commercial power supply 90 is also consumed by the second loads 80*a*, 80*b*, and 80*c* included in the respective extended option apparatuses 200*a*, 200*b*, and 200*c*.

Therefore, electric power consumed by the main heater 16 has to be reduced in order to prevent total power consumption of the commercial power supply 90 from exceeding the specified electric power (e.g., 1500 W). As a result, performance of heating of the fixing device 10 by the main heater 16 is deteriorated.

In this embodiment, the deterioration in the heating performance of the main heater 16 is covered by the second auxiliary power supplies 60*a*, 60*b*, and 60*c* dispersedly disposed in the respective extended option apparatuses 200*a*, 200*b*, and 200*c*.

In a state in which the extended option apparatuses 200*a*, 200*b*, and 200*c* are mounted, since capacities of the second auxiliary power supplies 60*a*, 60*b*, and 60*c* are added to the first auxiliary power supply 60 and a discharge time of the first and second auxiliary power supplies is increased as a whole. As a result, time during which the fixing device 10 is heated using both the main heater 16 and the auxiliary heater 17 is extended and a period in which a temperature rise gradient is high is extended. Thus, even in a state in which heating performance of the main heater 16 alone is low, it is possible to finish the warm-up within the specified time.

FIGS. 6A and 6B show a state in which three extended option apparatuses (i.e. 200*a*, 200*b* and 200*c*) are mounted simultaneously. However, the same effects are obtained when one or two extended option apparatuses are mounted. When the number of extended option apparatuses decreases, a discharge time of the auxiliary power supplies is decreased. However, since a consumption amount of the commercial power supply 90 consumed by the second load of the extended option apparatuses also decreases, it is possible to increase power consumption allocatable to the main heater 16 within the specified electric power of the commercial power supply 90. As a result, in this case, it is also possible to finish the warm-up within the specified time.

Figure 7:
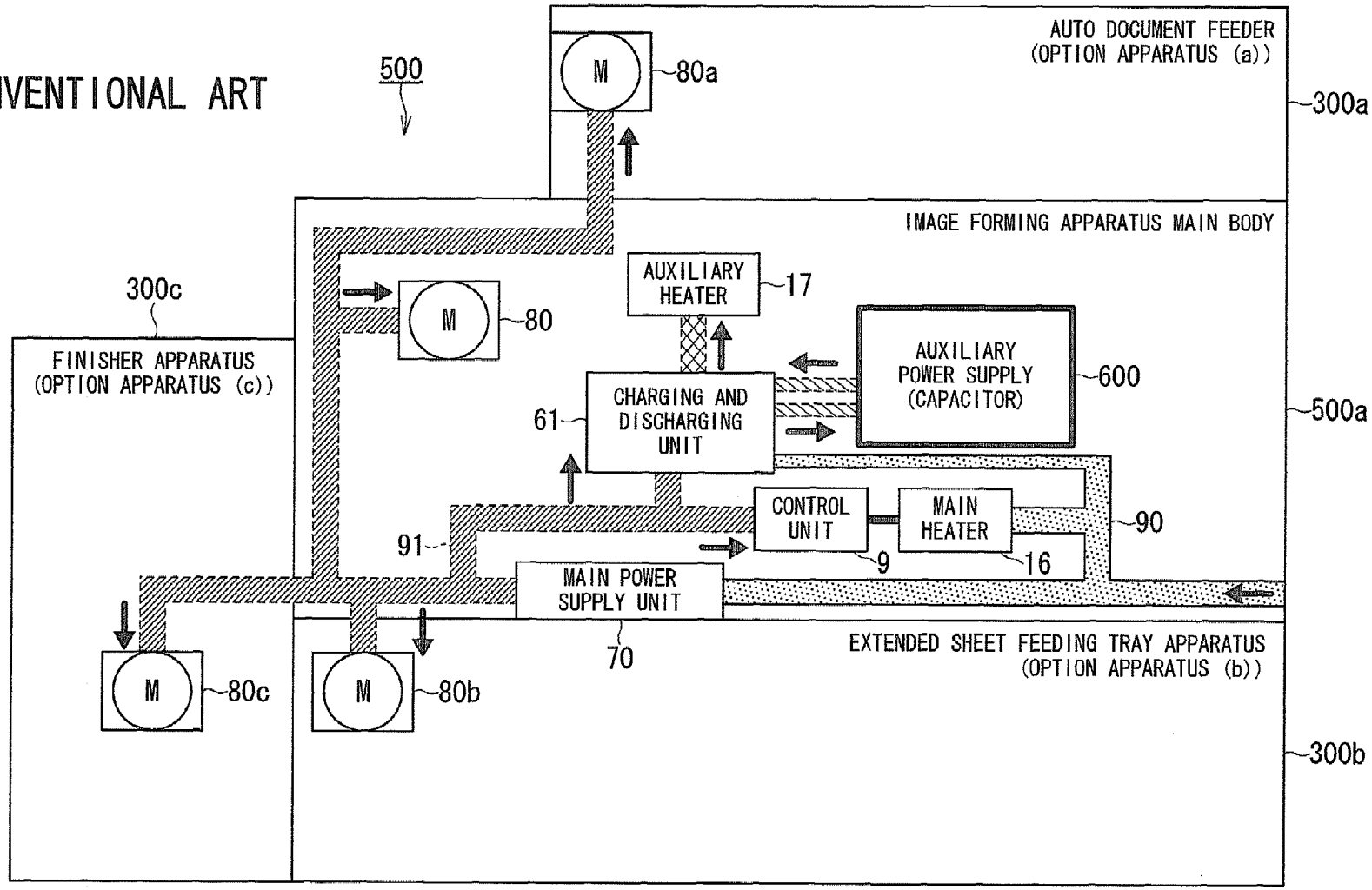
FIG. 7 CONVENTIONAL ART
FIG. 7 is a diagram showing an example of an overall structure of a conventional image forming apparatus and, in particular, chiefly showing an example of structures of a power supply system and a load thereof.

FIG. 7 is a diagram showing, for comparison with the image forming apparatus 1 according to this embodiment, an example of a structure of an image forming apparatus 500 of a form usually used conventionally.

The image forming apparatus 500 of the conventional type includes, like the image forming apparatus 1 according to the first embodiment, an auto document feeder 300*a*, an extended sheet feeding tray apparatus 300*b*, and a finisher apparatus 300*c* as extended option apparatuses detachably mountable on an image forming apparatus main body 500*a*. However, the auxiliary power supplies (the second auxiliary power supplies 60*a*, 60*b*, and 60*c*) are not provided in the respective extended option apparatuses and only the loads (the second loads 80*a*, 80*b*, and 80*c*) are disposed.

Therefore, unlike this embodiment, even when the extended option apparatuses are mounted, electric power of the auxiliary apparatuses is not supplemented from the respective apparatuses.

Figure 8A:
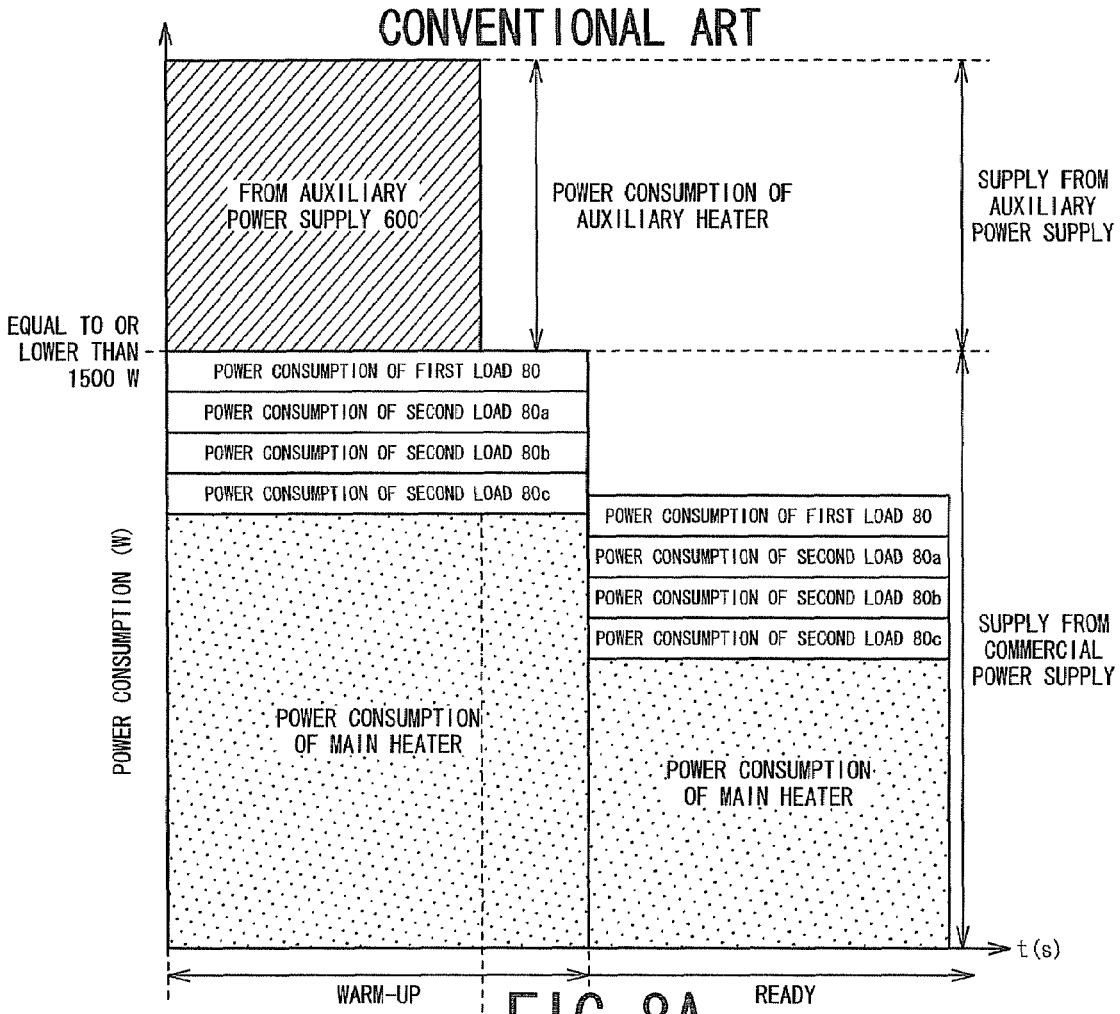
FIG. 8A is a diagram showing, together with elapse of time, the distribution of power consumption at the time when an extended option apparatus is mounted in the conventional image forming apparatus.
Figure 8B:
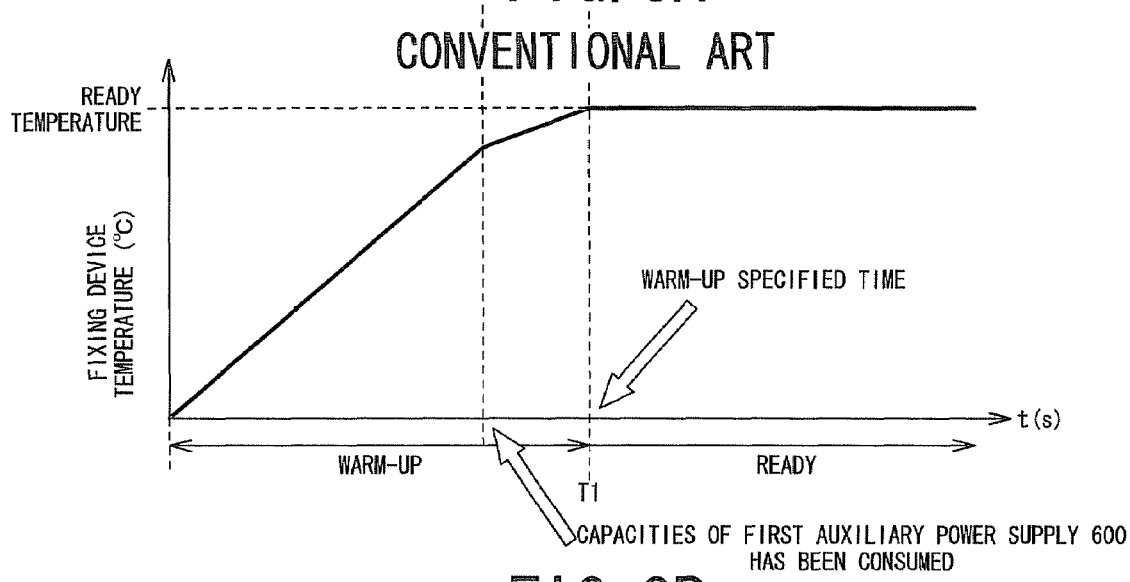
FIG. 8B is a diagram showing a change in a fixing temperature at that time together with elapse of time.

FIG. 8A is a diagram showing, together with elapse of time from the start of energization, transition of power consumption at the time when the extended option apparatuses are mounted in the image forming apparatus 500 of the conventional type. FIG. 8B is a diagram showing a change in a fixing temperature together with elapse of time from the start of energization.

In the image forming apparatus 500 of the conventional type, as in the image forming apparatus 1, when the extended option apparatuses are mounted, electric power of the commercial power supply 90 is consumed by the respective loads (the second loads 80*a*, 80*b*, and 80*c*). Thus, power consumption allocated to the main heater 16 has to be reduced in order to control power consumption of the entire commercial power supply 90 to be equal to or lower than the specified electric power (e.g., 1500 W).

On the other hand, in order to finish warm-up within the specified time T1, it is necessary to heat the fixing device 10 with the auxiliary heater 17 in addition to the main heater 16. Because of these conditions and requirements, eventually, in the image forming apparatus 500 of the conventional type, a capacity of an auxiliary power supply 600 included in the image forming apparatus main body 500*a* has to be increased. Thus, the image forming apparatus main body 500*a* is increased in size and cost.

Figure 9A:
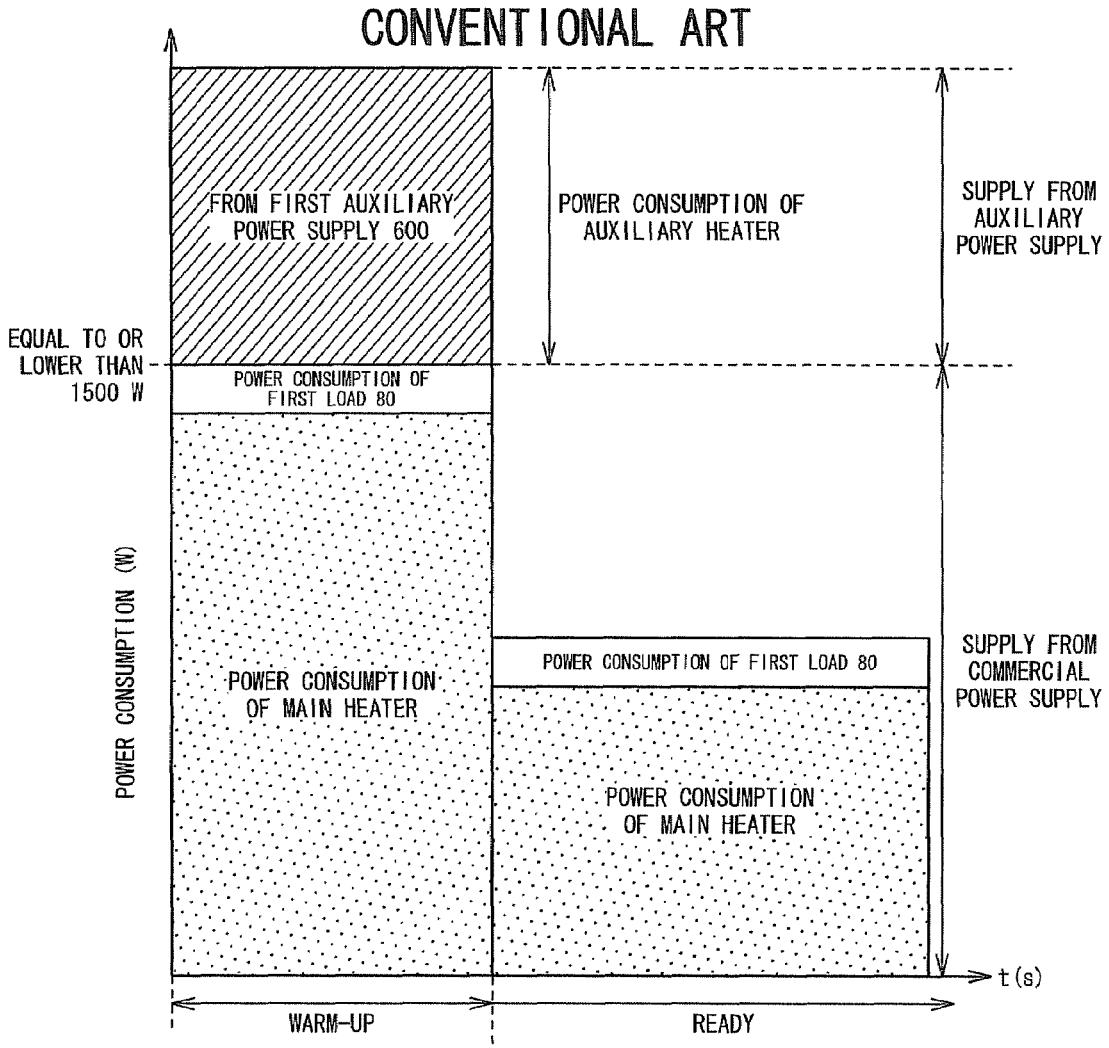
FIG. 9A is a diagram showing, together with elapse of time, the distribution of power consumption at the time when the extended option apparatus is not mounted in the conventional image forming apparatus.
Figure 9B:
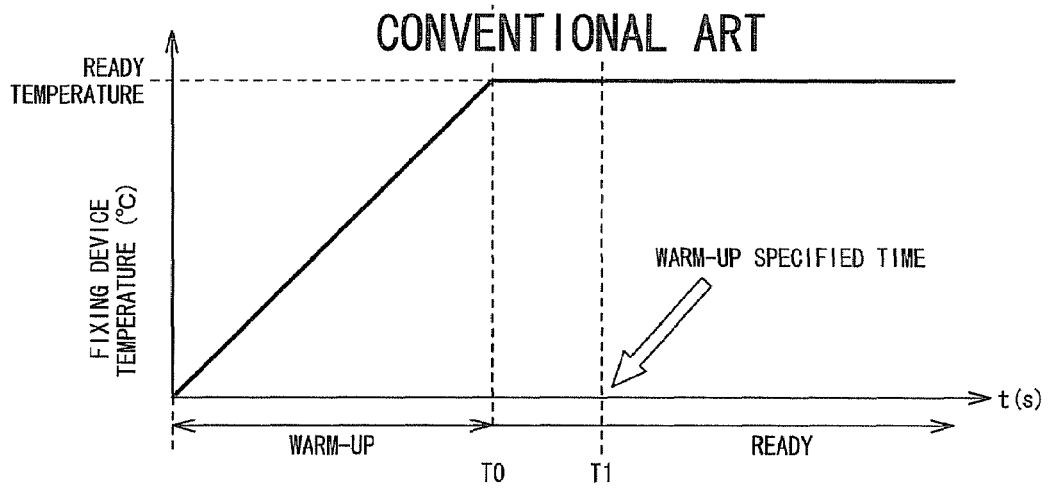
FIG. 9B is a diagram showing a change in a fixing temperature at that time together with elapse of time.

FIG. 9A is a diagram showing, together with elapse of time from the start of energization, transition of power consumption at the time when the extended option apparatuses are not mounted in the image forming apparatus 500 of the conventional type. FIG. 9B is a diagram showing a change in a fixing temperature together with elapse of time from the start of energization.

In the image forming apparatus 500 of the conventional type, the large-capacity auxiliary power supply 600 is included in the image forming apparatus main body 500*a*. Thus, there is a margin in the capacity of the auxiliary power supply 600 when the extended option apparatuses are not mounted. The warm-up is finished in time T0 shorter than the specified time T1.

As described above, in the image forming apparatus 500 of the conventional type, in order to satisfy performance (warm-up time) at the time when the extended option apparatuses are mounted, the auxiliary power supply 600 of the image forming apparatus main body 500*a* has to be increased in size. On the other hand, when the extended option apparatuses are not mounted, imbalance occurs in that warm-up time is reduced more than necessary.

On the other hand, in the image forming apparatus 1 according to this embodiment, the auxiliary power supplies (the second auxiliary power supplies 60*a*, 60*b*, and 60*c*) are dispersedly arranged in the respective extended option apparatuses. Thus, even if the auxiliary power supply 60 included in the image forming apparatus main body 100 has a small capacity, it is possible to finish the warm-up of the fixing device 10 within the specified time at both the times when the extended option apparatuses are mounted and when the extended option apparatuses are not mounted. In other words, the image forming apparatus 1 is well balanced in terms of performance and low cost at both the times when the extended option apparatuses are mounted and when the extended option apparatuses are not mounted.

The invention is not limited to the embodiments described above per se. At an implementation stage, it is possible to modify and embody the elements without departing from the spirit of the invention. It is possible to form various embodiments of the invention according to appropriate combinations of the plural elements disclosed in the embodiments. For example, several elements may be deleted from all the elements described in the embodiments. Moreover, the elements described in the different embodiments may be combined as appropriate.

What is claimed is:

1. An image forming apparatus comprising:

an image forming apparatus main body; and at least one option apparatus that is mounted on the image forming apparatus main body when functions are extended, wherein the image forming apparatus main body comprises:

a main power supply unit configured to convert a commercial power supply into a predetermined voltage;

a first load that is driven on the basis of electric power supplied from the main power supply unit;

a first auxiliary power supply that is charged by the commercial power supply; and a fixing device including a main heater that is heated on the basis of electric power supplied from the commercial power supply and an auxiliary heater that is heated on the basis of electric power supplied from the first auxiliary power supply, and the at least one option apparatus comprises:

a second load that is driven on the basis of electric power supplied from the main power supply unit when the at least one option apparatus is mounted on the image forming apparatus main body; and a second auxiliary power supply that is charged by the commercial power supply when the at least one option apparatus is mounted on the image forming apparatus main body and, on the other hand, heats the auxiliary heater in conjunction with the first auxiliary power supply.

2. An image forming apparatus according to claim 1, wherein the first auxiliary power supply and the second auxiliary power supply are electric double layer capacitors and are connected in parallel to each other when the at least one option apparatus is mounted on the image forming apparatus main body.

3. An image forming apparatus according to claim 1, wherein the at least one option apparatus is an apparatus including at least one of an auto document feeder that automatically feeds plural originals, an extended sheet feeding tray apparatus that stores and feeds plural recording sheets having different sizes, and a finisher apparatus that classifies the recording sheets, which are printed in plural copies, for each of the copies and discharges the recording sheets.

4. An image forming apparatus according to claim 1, wherein the image forming apparatus main body heats both the main heater and the auxiliary heater when a temperature of the fixing device is equal to or lower than a predetermined temperature.

5. An image forming apparatus according to claim 1, wherein electric power of the commercial power supply supplied to the image forming apparatus main body is within a range of electric power that can be supplied from one wall outlet by one power supply cable.

6. An image forming apparatus according to claim 5, wherein electric power of the commercial power supply is 1500 W at the maximum.

7. A control method of an image forming apparatus including an image forming apparatus main body and at least one option apparatus that is mounted on the image forming apparatus main body when functions are extended, the control method of the image forming apparatus comprising, in the image forming apparatus main body:

converting a commercial power supply into a predetermined voltage in a main power supply unit;

driving a first load on the basis of electric power supplied from the main power supply unit:

charging a first auxiliary power supply with the commercial power supply;

heating a main heater included in a fixing device on the basis of electric power supplied from the commercial power supply;

heating an auxiliary heater further included in the fixing device on the basis of electric power supplied from the first auxiliary power supply and when the at least one option apparatus is mounted on the image forming apparatus main body, driving a second load included in the at least one option apparatus on the basis of electric power supplied from the main power supply unit; and charging a second auxiliary power supply included in the at least one option apparatus with the commercial power supply, and, on the other hand, heating the auxiliary heater with both the second auxiliary power supply and the first auxiliary power supply.

8. A control method of an image forming apparatus according to claim 7, wherein the first auxiliary power supply and the second auxiliary power supply are electric double layer capacitors and are connected in parallel to each other to heat the auxiliary heater when the at least one option apparatus is mounted on the image forming apparatus main body.

9. A control method of an image forming apparatus according to claim 7, wherein the at least one option apparatus is an apparatus including at least one of an auto document feeder that automatically feeds plural originals, an extended sheet feeding tray apparatus that stores and feeds plural recording sheets having different sizes, and a finisher apparatus that classifies the recording sheets, which are printed in plural copies, for each kind of the copies and discharges the recording sheets.

10. A control method of an image forming apparatus according to claim 7, wherein both the main heater and the auxiliary heater are heated when a temperature of the fixing device is equal to or lower than a predetermined temperature.

11. A control method of an image forming apparatus according to claim 7, wherein electric power of the commercial power supply supplied to the image forming apparatus main body is within a range of electric power that can be supplied from one wall outlet by one power supply cable.

12. A control method of an image forming apparatus according to claim 11, wherein electric power of the commercial power supply is 1500 W at the maximum.

* * * * *